US005702189A

United States Patent [19]

Mizutani et al.

[11] Patent Number: 5,702,189

[45] Date of Patent: Dec. 30, 1997

[54] RACK AND PINION CLEANING MECHANISM IN A SERIAL PRINTER

[75] Inventors: Minoru Mizutani; Kuniharu Hayashi; Koji Aida, all of Tokyo, Japan

[73] Assignee: Oki Electric Industry Co., Ltd., Tokyo, Japan

[21] Appl. No.: 356,818

[22] Filed: Dec. 15, 1994

[30] Foreign Application Priority Data

Dec. 24, 1993 [JP] Japan ..... 5-327368

[51] Int. Cl.[6] ..... B41J 19/20

[52] U.S. Cl. ..... 400/328; 400/320; 400/701; 74/422

[58] Field of Search ..... 400/320, 328, 400/701, 690.4; 74/422

[56] References Cited

U.S. PATENT DOCUMENTS

| | | | |
|---|---|---|---|
| 4,461,588 | 7/1984 | Watanabe et al. | 400/328 |
| 4,576,490 | 3/1986 | Isobe | 400/82 |
| 4,738,552 | 4/1988 | Kikuchi et al. | 400/59 |

FOREIGN PATENT DOCUMENTS

| | | | |
|---|---|---|---|
| 0 470 487 | 2/1992 | European Pat. Off. . | |
| 0 501 789 | 9/1992 | European Pat. Off. . | |
| 56-161183 | 12/1981 | Japan | 400/328 |
| 61-252182 | 11/1986 | Japan | 400/690.4 |
| 5-138991 | 6/1993 | Japan | 400/701 |

*Primary Examiner*—David A. Wiecking

*Attorney, Agent, or Firm*—Panitch Schwarze Jacobs & Nadel, P.C.

[57] ABSTRACT

In a serial printer a pinion and a rack for lateral movement of a carriage, a dislodging member with edges proximate to the rack is provided to remove any chads or other foreign matters that may be attached to the rack, as they approach the pinion with the lateral movement of the carriage. The chads or other foreign matters are prevented from being caught between the pinion and the rack, and noises and increase in the torque due to the rolling in is prevented.

18 Claims, 6 Drawing Sheets

RACK AND PINION CLEANING MECHANISM IN A SERIAL PRINTER

The present invention relates to a serial printer, and particularly to its carriage movement mechanism, for laterally moving the print head in the direction parallel to the surface of the platen, or parallel to the axis of a cylindrical platen.

Carriage movement mechanisms used in serial printers, for laterally moving a carriage on which a print head is mounted, are usually formed of a pinion rotatably mounted to the carriage, a rack fixed to the housing of the printer, extending in the direction of the lateral movement of the carriage and meshing with the pinion, and a guide shaft fixed to the housing of the printer and provided in parallel with the rack. The carriage is slidably mounted to the guide shaft, and is moved by rotation of the pinion meshing with the rack. Where the platen is cylindrical, the carriage is moved in parallel with the axis of the platen. Where the platen is planar the carriage is moved in parallel with the surface of the platen. The print head is driven in timed relationship with the lateral movement of the carriage, to perform printing on a printing medium passing over the platen.

In a printer of the bottom-pull type, a printing medium, such as a sprocket paper, is inserted into the printer housing from the lower or bottom part of the printer, and passed over the platen. This is to minimize the turning or curvature of the printing medium while it is fed through the printer. Minimizing the curvature is particularly advantageous where the printing medium is thick, such as when the printing medium consists of a multiply-paper, typically in the form of sprocket paper. When the sprocket paper is used as the printing medium, pull tractors are used for supporting and feeding the sprocket paper. The pull tractors have pins which are engaged with the sprocket holes of the sprocket paper and the pins are rotated for feeding the sprocket paper. In the bottom-pull printer, the pull tractors are usually positioned above the platen to apply a certain tension to the sprocket paper passing over the platen, to thereby smoothly feed or convey the sprocket paper over the platen.

In the conventional carriage movement mechanism, the rack is formed of an insulating material such as plastics or hard rubber, and is charged with static electricity, so that fine dust or paper scrap may be attracted to it. In the printer of the bottom-pull type, If the sprocket paper that is loaded on the printer has their sprocket holes incompletely open, i.e., has circular pieces of paper, called chads, left unremoved from the sprocket holes, the chads will be released when the pins are engaged with the sprocket holes, and may be attracted to the rack. Then, the chads may be caught between the rack and the pinion during carriage movement, creating unpleasant noises.

Moreover, when a chad is caught between the rack and the pinion, the load on the motor driving the pinion for movement of the carriage is increased, and the lifetime of the motor is shortened.

SUMMARY OF THE INVENTION

An object of the invention is to prevent chads or any other foreign matters to be caught between the pinon and the rack.

A serial printer according to the present invention comprises a carriage on which a print head is mounted, and which is capable of translation movement;

a pinon rotatably mounted to the carriage;

a rack meshing with the pinon; and a dislodging member having an edge proximate to the rack and provided adjacent to the pinion whereby said dislodging member serves to remove, by means of said edge, any foreign matters approaching the gap between the rack and the pinion.

With the arrangement described above, foreign matters such as chads attached to the rack will be removed by the dislodging member before they approach the gap between the pinion and the rack. Accordingly, they are prevented from being caught between the pinion and the rack. Although the chads which lie flush against the teeth of the rack may not be removed, they may spring upright as they pass the gap between the pinion and the rack, and after that they will be removed, when they next pass the dislodging member. Anyway, the foreign matters are less frequently caught between the pinion and the rack.

Because rolling-in of foreign matters into the gap between the pinion and the rack is reduced, generation of unpleasant noises can be reduced. Moreover, as the load of the spacing motor is reduced, its lifetime is extended.

DETAILED DESCRIPTION OF THE PREFERRED EMBODIMENTS

Embodiments of the invention will now be described with reference to the drawings. Elements common to all various drawings are denoted by identical reference marks.

Embodiment 1

Figure 1:
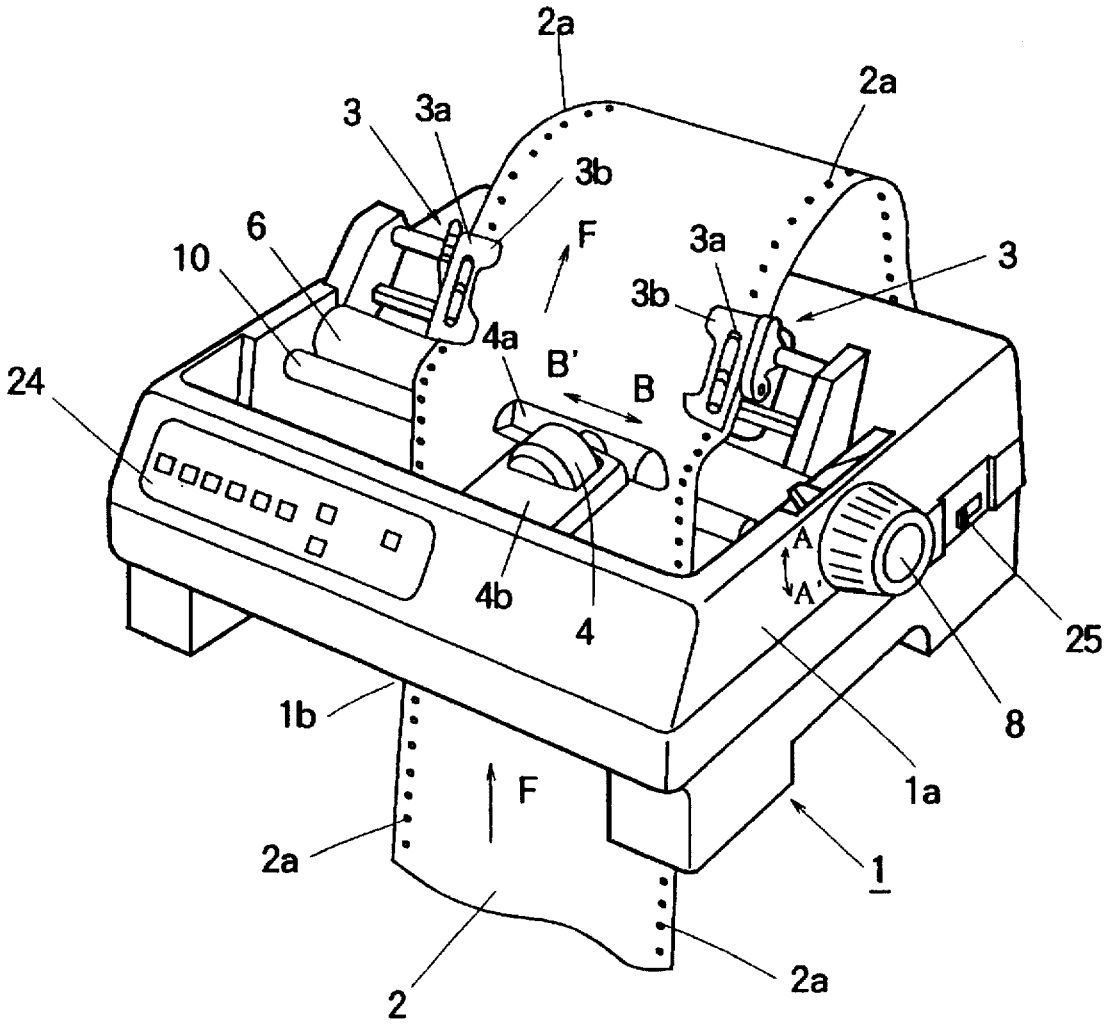
FIG. 1 is a perspective view showing a printer of the bottom-pull type.

Referring first to FIG. 1, a serial printer 1 of this embodiment of the invention is of the bottom-pull type. In the bottom-pull type printer, denoted by a reference numeral 1, a printing medium such as sprocket paper 2 is inserted through an opening **1*b* provided in the bottom part of a housing 1*a* of the printer 1, and pulled by a pair of pull tractors 3 positioned above a platen 6, so that the sprocket paper 2 is fed in the direction of the arrows F, and passed over the platen 6**.

The platen 6 in the illustrated embodiment is cylindrical and extends laterally, and rotatably supported by the housing **1*a* of the printer 1. The platen 6 is rotatable, being driven by means not shown. The platen 6 can also be rotated manually by means a knob 8 attached to the housing 1*a***.

The pull tractors 3 have pins **3*a* engageable with sprocket holes 2*a* provided along edges of the sprocket paper 2. As the pull tractors 3 rotate, the pins 3*a* rotate to pull the sprocket paper 2**.

A print head 4 is provided to confront the platen 6. The print head 4 is provided with a ribbon cassette 4b and a ribbon guide 4a. The sprocket paper 2 is passed between the ribbon guide 4a and the platen 6. The print head 4 is mounted on a carriages 13, shown In FIG. 2.

The carriage 13 is laterally movable, i.e., movable along a guide shaft 10 and a guide rail 15 (FIG. 2) extending laterally, in parallel with the axis of the cylindrical platen 6, and fixed to the housing 1a of the printer 1.

The carriage 13 is formed of a mounting part 13a, an annular part 13b and a mounting plate 13c. Mounted on the mounting part 13a is the print head 4. The annular part 13 is mounted in such a manner that it is slidable along the guide shaft 10. One end of the mounting plate 13c is mounted to the rail 15, by means of a sliding member 14. in such a manner that it is slidable along the rail 15.

A rack 16 formed of a plastic material is also provided in the housing of the printer 1, in parallel with the axis of the platen 6, the guide shaft 10 and the rail 16, shown in FIG. 1.

Figure 2:
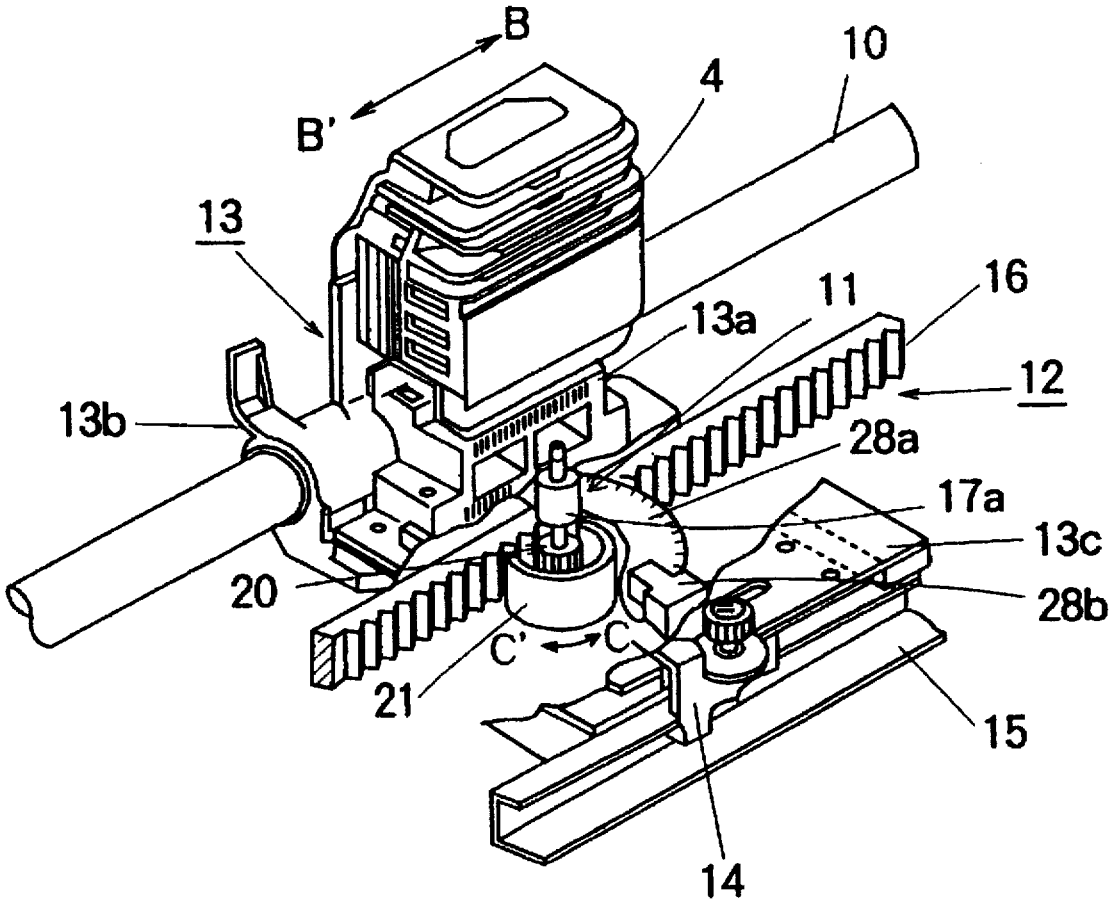
FIG. 2 is a perspective view showing a carriage movement mechanism, with a dislodging member of a first embodiment of the invention.
Figure 3:
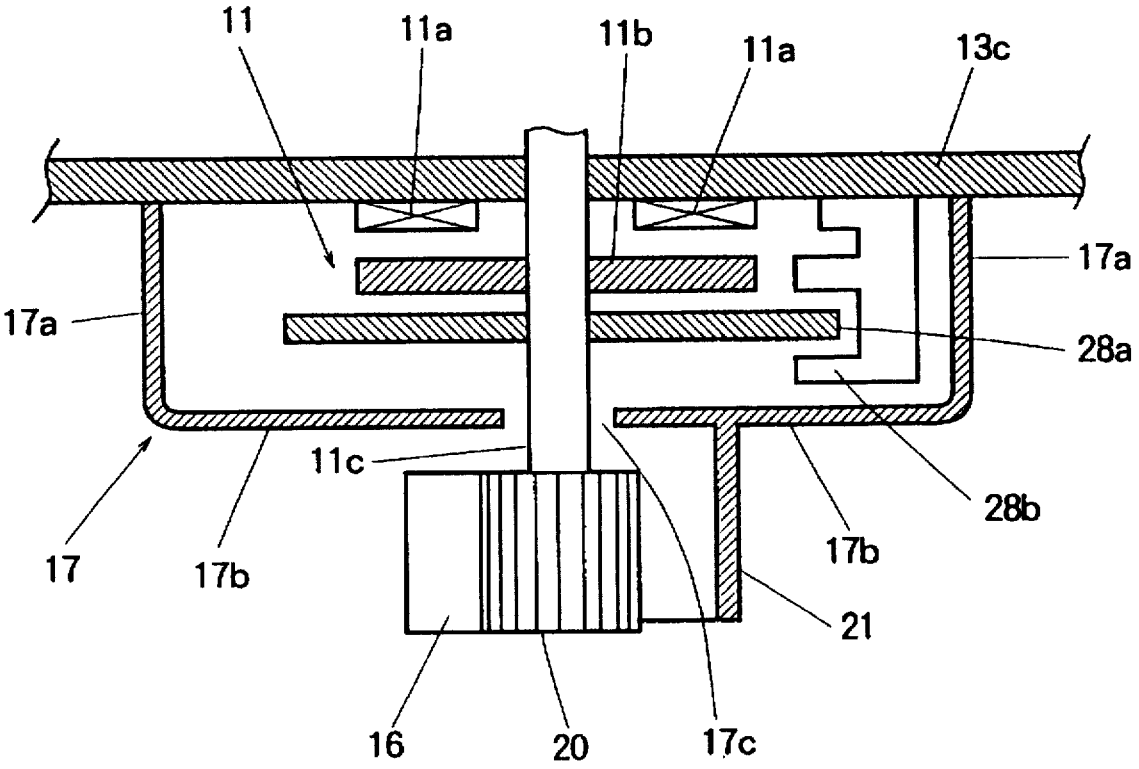
FIG. 3 is a sectional view showing the spacing motor, the slit disk, the motor cover and the dislodging member.
Figure 4:
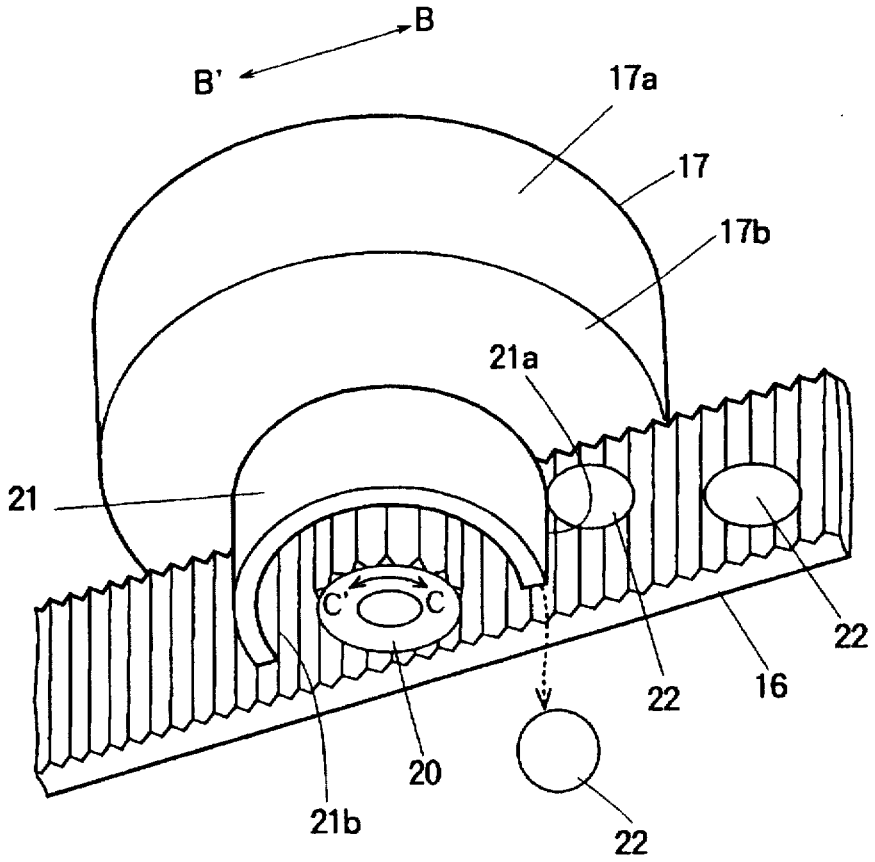
FIG. 4 is an enlarged perspective view showing the dislodging member of the first embodiment.

As is better seen from FIG. 2 and FIG. 3, a rotation shaft 11c of a spacing motor 11 is rotatably supported by the mounting plate 13c of the carriage 13, and a pinion 20 is fixed to the rotation shaft 11c. The pinion 20 meshes with the rack 16. The stator 11a of the spacing motor 11 is fixed to the mounting plate 13c.

A slit disk 28a is also fixed to the rotation shaft 11c and rotates together with the rotor 11b. A sensor 28b is fixed to the mounting plate 13c to detect the rotational position of the slit disk 28a.

A motor cover 17 is provided to cover the stator 11a, the rotor 11b, the slit disk 28a and the sensor 28b. The motor cover 17 has a generally cylindrical wall 17a having an upper end connected and fixed to the mounting plate 13c, and a disk-shaped bottom plate 17b closing the lower edge of the cylindrical wall 17a. The bottom plate 17b of the motor cover 17 has a hole 17c through which the rotation shaft 11c extends.

A dislodging member 21 is attached to the bottom plate 17b. The motor cover 17 may be formed of a plastic material.

The dislodging member 21 is substantially semi-cylindrical, substantially encloses the pinion 20, and has edges 21a and 21b proximate to the rack 16, and opposite to each other with respect to the pinion 20. The edges 21a and 21b of the dislodging member 21 are proximate to the rack 16, but do not collide with the rack 16 during carriage movement. In an example, the gap between the edges 21a and 21b with the peaks of the teeth of the rack 20 is 0.57 mm, where the teeth height is 1.04 mm, the teeth pitch is 1.451 mm, and the width of the rack is 6.3 mm. Incidentally, the inner radius of the dislodging member is 4.5 mm, and the thickness of the dislodging member is 1 mm. The dislodging member 21 may be formed of a plastic material. The motor cover 17 and the dislodging member 21 may be formed as an integral body, e.g., by integral molding.

An operation section 24 provided on the front part of the housing 1a of the printer is used for manual input of commands necessary with regard to the operation of the printer.

To conduct printing, a power switch 25 is first turned on, and print commands may be input by means of an operation section 24. The sprocket paper 2 is inserted from the bottom of the printer 1. The sprocket paper 2 is passed between the platen 6 and the ribbon guide 4a of the print head 4. and its both edges are clamped by the clamping members 3b of the pull tractors 3. With the both edges of the sprocket paper 2 clamped by the clamping members 3b, the pins 3a of the pull tractors 3 engage with the sprocket holes 2a in the sprocket paper 2. When the pins 3a are rotated, with the pins 3a in engagement with the sprocket holes 2a, the sprocket paper 2 is pulled, and is thereby fed in the direction of the arrows F.

When required, the platen knob 8 is rotated in the direction of arrow A–A' for manually feeding the sprocket paper 2, e.g., for adjusting the position of the paper at the time of commencement of the printing.

During printing, the carriage 13, on which the print head 4 is mounted, is laterally moved in the direction of arrow B–B', while sliding along the guide shaft 10. In timed relationship with the lateral movement, print wires, not shown, of the print head 4 are driven selectively to print characters or the like on the sprocket paper 2 through an ink ribbon, not shown, contained in the ink ribbon cassette 4b.

For the lateral movement of the carriage 13, the spacing motor 11 is energized via a flexible cable, not shown, and the spacing motor rotates 17. The pinion 16 attached to the rotation shaft 11c of the spacing motor rotates in the direction of the arrow C or C', being driven by the spacing motor 11. The pinion 20 meshes with the rack 16, so that the carriage 13 moves in the direction of arrow B when the pinion 20 rotates in the direction of arrow C. When the pinion 20 rotates in the direction of arrow C', the carriage 13 moves in the direction of arrow B'.

Figure 5:
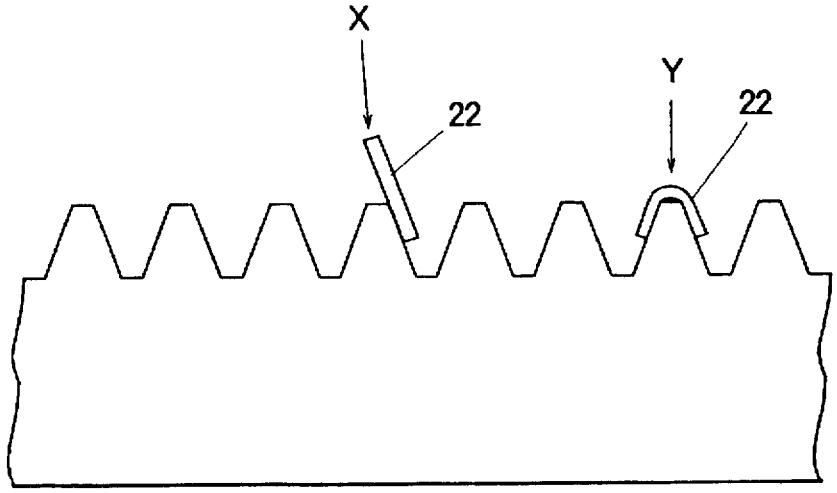
FIG. 5 is an enlarged view showing chads projecting away from the rack and lying flush against the teeth of the rack.

If the sprocket holes 2a or the sprocket paper 2 are not completely open and the chads 22 are left unremoved from the sprocket holes 2a, chads 22 may be detached when the pins 3a of the sprocket tractors 3 are brought into engagement with the sprocket holes 2a, and may be attached to the rack 16, by electrostatic force due to static charge on the rack 16. In such a case, when the carriage 13 is moved, the edge 21a or 21b of the dislodging member 21 serve to remove the chads 22 during movement of the dislodging member 21 in the direction of arrow B or B'. Removal 1s achieved if the chad is projecting away from the rack at part only thereof, as indicated by mark X in FIG. 5. If the chad lies flush against the teeth of the rack 16 as indicated by Y in FIG. 5, then removal may not be achieved. However, the chad may spring upright when it is caught between the pinion and the rack, and is therefore squeezed. Then, the chad will be removal during subsequent passage of the dislodging member edge 21a or 21b. Other foreign matters, such as paper scraps and dusts, attached to the rack 16 are also removed.

Thus, entry of the chads and other foreign matters into the gap between the pinion and the rack, which causes noises and increases in the load of the spacing motor, is reduced.

Embodiment 2

Figure 6:
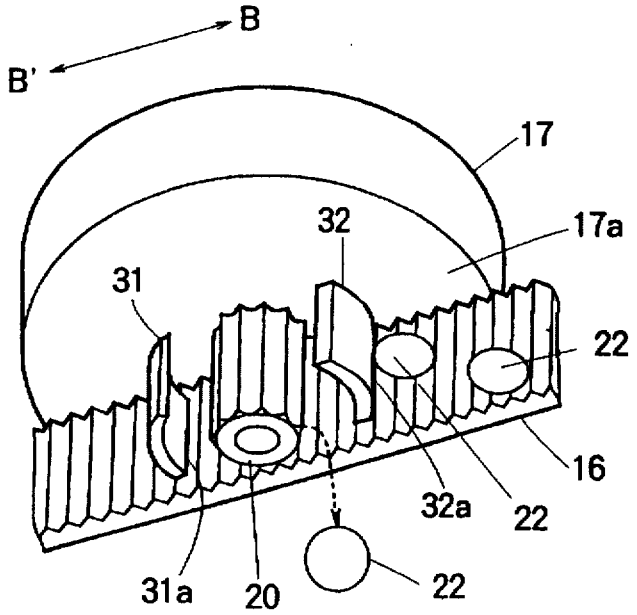
FIG. 6 is an enlarged perspective view showing a dislodging member of the second embodiment.

In the embodiment described above, the dislodging member is cylindrical. However, it may alternatively be configured as shown in FIG. 6. The illustrated dislodging member comprises a pair of partial cylindrical members 31 and 32, disposed opposite to each other with respect to the pinion 20, and each having one edge 31a, 32a proximate to the rack 16, to such a degree that they do not collide with the rack 16. The partial cylindrical members 31 and 32 are fixed, at their one ends. to the bottom plate 17b of the motor cover 17. Because of the above arrangement, the pinion 20 is between the partial cylindrical members 31 and 32, and partially covered by the partial cylindrical members 31 and 32. The carriage movement mechanism 12 and other components, and the lateral movement of the second embodiment are similar to those of the first embodiment, and their description is omitted.

If chads 22 are attached to the rack 16 for the reason explained in connection with the first embodiment, they are removed by the edges 31*a* and 32*a* of the partial cylindrical members 31 and 32 during movement of the carriage 13 in the direction of the arrow B or arrow B' as they approach the pinion. Other foreign matters attached to the rack 16 are also removed. In the second embodiment, it is also possible to insert fingers or tools through the gap between the partial cylindrical members 31 and 32 to remove any chad, or other foreign matters which may be present on or near the pinion, between the cylindrical members 31 and 32.

In an example, the height of the partial cylindrical members 31 and 32 is 4.46 mm. The dimension of the gap between the edges 31*a* and 32*a* and the rack 16 is identical to the dimension of the gap between the edges 21*a* and 21*b* of the dislodging member 21 in the first embodiment, the inner radius and the thickness of the partial cylindrical members 31 and 32 is identical to those of the dislodging member 21 in the first embodiment.

Embodiment 3

Figure 7:
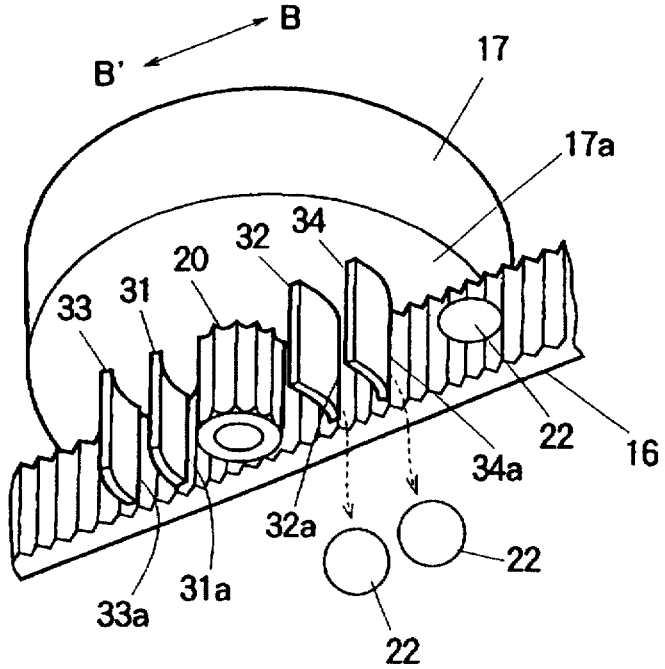
FIG. 7 is an enlarged perspective view showing a dislodging member of the third embodiment.

In the embodiment described, a pair of partial cylindrical members 31 and 32 are provided. In addition to the partial cylindrical members 31 and 32, another pair of partial cylindrical members 33 and 34 may be provided, as shown in FIG. 7. That is, the additional partial cylindrical members 33 and 34 are provided adjacent to the partial cylindrical members 31 and 32, and farther away from the pinion 20 than the partial cylindrical members 31 and 32. Thus, the partial cylindrical members are provided in duplication on each side of the pinion 20.

The partial cylindrical members 33 and 34 are also provided in such a manner that their edges 33*a* and 34*a* are proximate to the rack 16 to such a degree that they do not collide with the rack 16 during movement of the carriage 13. The carriage movement mechanism 12 and the other components of the third embodiment are similar to those of the first embodiment, so their description is omitted.

If chads 22 are attached to the rack 16 for the reason explained in connection with the first embodiment, they are removed by the edges 33*a* and 34*a* of the partial cylindrical members 33 and 34 as they approach the pinion, during movement in the direction of the arrow B or arrow B'. Other foreign matters in the carriage movement space and attached to the rack 16 are also removed.

If any chads 22 or other foreign matters which are not removed by the partial cylindrical members 33 and 34, they may be removed by the partial cylindrical members 31 and 32 provided inside the partial cylindrical members 33 and 34. Accordingly, the probability that the chads 22 or other foreign matters are removed before they reach the pinion 20 is increased. Moreover, like the second embodiment, fingers or tools may be Inserted through the gap between the partial cylindrical members 31 and 32 to remove any chads 22 or other foreign matters present on or near the pinion, between the partial cylindrical members 31 and 32.

Modifications

Figure 8:
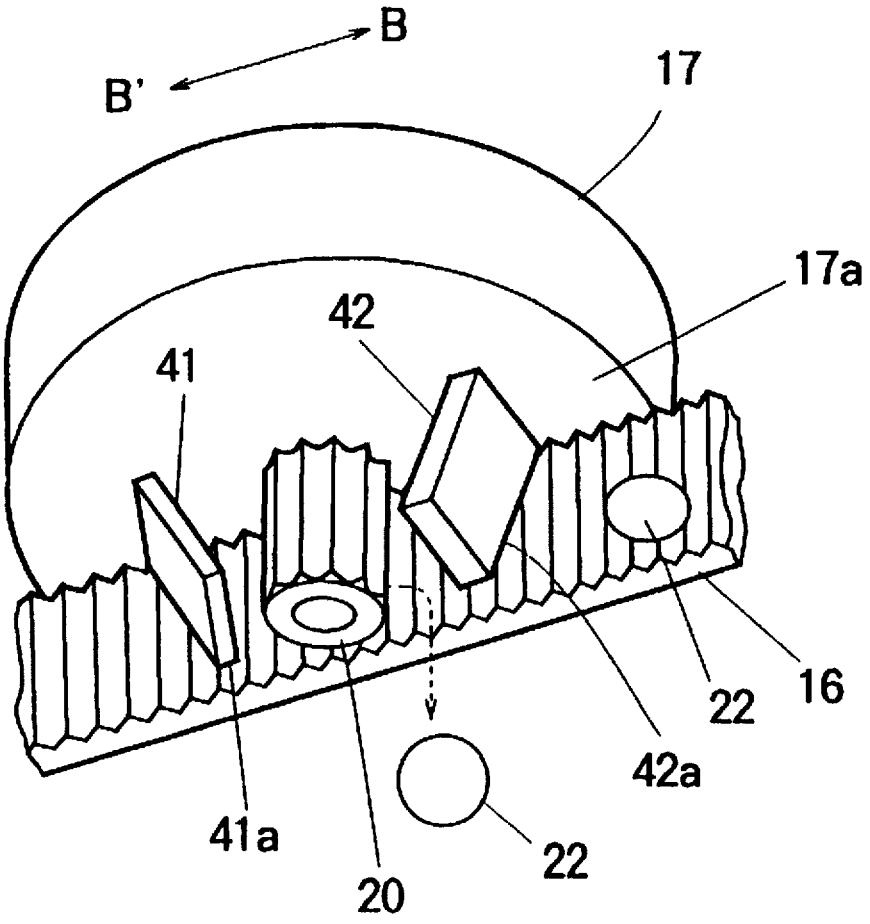
FIG. 8 is a perspective view showing a modification of the dislodging member.

In place of the partial cylindrical members 31 and 32 in the second embodiment, or the partial cylindrical members 31, 32, 33 and 34 in the third embodiment, flat members 41 and 42, shown in FIG. 8, with edges 41*a* and 42*a* proximate to the rack may be used. Moreover, the edges 41*a* and 42*a* may not be parallel with the axis of the pinion, but may be inclined (at an angle other than a right angle) as shown in FIG. 8. Such a inclined arrangement of the edges of the dislodging member can be applied even where the dislodging member is formed of curved plates. In the embodiments described, the dislodging member has edges proximate to the rack on both sides of the pinion. However, the edge may be provided only on one side of the pinion. Providing the edge at only one side has the effect of reducing rolling-in of chads and other foreign matters into between the pinion and the rack.

What is claimed is:

1. A serial printer, comprising a carriage on which a print head is mounted, and which is capable of translation movement;

pull tractors for feeding sprocket paper past the printing head;

a pinion rotatably mounted to the carriage;

a rack meshing with the pinion at a meshing region therebetween, the rack having teeth with peaks; and a dislodging member having an edge proximate to the peaks of the teeth of the rack and provided adjacent to the pinion, the edge of the dislodging member and the peaks of the teeth of the rack defining a gap therebetween, whereby said dislodging member serves to remove, by means of said edge, chads released from said sprocket paper, attached to the rack, and approaching the meshing region between the rack and the pinion, the gap between the edge of the dislodging member and the peaks of the teeth of the rack being set to permit engagement of the edge of the dislodging member with the chad, when the chad projects away from the surface of the rack, to thereby enable removal of the chad by said engagement of said edge of the dislodging member with the chad.

2. A serial printer as set forth in claim 1, wherein the dislodging member is mounted to the carriage.

3. A serial printer as set forth in claim 1, wherein the dislodging member is mounted to a cover of a motor provided to drive the pinion.

4. A serial printer as set in claim 1, wherein the dislodging member has an additional edge provided opposite to the first-mentioned edge with respect to the pinion, and also proximate to the rack.

5. A serial printer as set forth in claim 4, wherein the dislodging member is substantially semi-cylindrical, having edges defining the first-mentioned edge and the additional edge.

6. A serial printer as set forth in claim 1, wherein the dislodging member comprises a first member and a second member opposite to each other with respect to the pinion and having the first-mentioned edge and an additional edge.

7. A serial printer as set forth in claim 6, wherein the dislodging member further comprises a third member and a fourth member which are respectively provided adjacent to the first and second members, and have further edges proximate to the rack.

8. A serial printer as set forth in claim 1, wherein the edge extends across a width of the rack.

9. A serial printer as set forth in claim 1, wherein the edge extends in a direction inclined with respect to the longitudinal direction of the rack.

10. A serial printed, comprising a carriage on which a print head is mounted, and which is capable of translation movement;

a pinion rotatably mounted to the carriage;

a rack meshing with the pinion at a meshing region therebetween, the rack extending substantially longitudinally and having a width extending substantially transversely;

a dislodging member having an edge proximate to and a pre-determined distance away from the rack and provided adjacent to the pinion, the edge extending across substantially the width of the rack, whereby said dislodging member serves to remove, by means of said edge, foreign matter attached to the rack and approaching the meshing region between the rack and the pinion; and a cover extending over the pinion, the dislodging member, and a portion of the rack between the pinion and the dislodging member;

wherein said dislodging member is mounted to a cover of a motor provided to drive the pinion.

11. A serial printer as set forth in claim 10, wherein said edge of the dislodging member is substantially parallel with an imaginary plane connecting the peaks of the teeth of the rack.

12. A serial printer, comprising a carriage on which a print head is mounted, and which is capable of translation movement;

a pinion rotatably mounted to the carriage;

a rack meshing with the pinion at a meshing region therebetween, the rack extending substantially longitudinally and having a width extending substantially transversely;

a dislodging member having an edge proximate to and a pre-determined distance away from the rack and provided adjacent to the pinion, the edge extending across substantially the width of the rack, whereby said dislodging member serves to remove, by means of said edge, foreign matter attached to the rack and approaching the meshing region between the rack and the pinion; and a cover extending over the pinion, the dislodging member and a portion of the rack between the pinion and the dislodging member;

wherein said dislodging member has an additional edge provided opposite to said first-mentioned edge with respect to said pinion, and also proximate to said rack; and wherein said dislodging member is substantially semi-cylindrical, having edges defining said first-mentioned edge and said additional edge.

13. A serial printer as set forth in claim 12, wherein said dislodging member is mounted to the carriage.

14. A serial printer as set forth in claim 12, wherein said edge of the dislodging member is substantially parallel with an imaginary plane connecting the peaks of the teeth of the rack.

15. A serial printer comprising a carriage on which a print head is mounted, and which is capable of translation movement;

a pinion rotatably mounted to the carriage;

a rack meshing with the pinion at a meshing region therebetween, the rack extending substantially longitudinally and having a width extending substantially transversely;

a dislodging member having an edge proximate to and a pre-determined distance away from the rack and provided adjacent to the pinion, the edge extending across substantially the width of the rack, whereby said dislodging member serves to remove, by means of said edge, foreign matter attached to the rack and approaching he meshing region between the rack and the pinion; and a cover extending over the pinion, the dislodging member, and a portion of the rack between the pinion and the dislodging member;

wherein said dislodging member comprises a first member and a second member opposite to each other with respect to said pinion and having said first-mentioned edge and an additional edge provided opposite to said first-mentioned egde with respect to said pinion; and wherein said dislodging member further comprises a third member and a fourth member which are respectively provided adjacent to said first and second members, and have further edges proximate to said rack.

16. A serial printer as set forth in claim 15, wherein said edge extends in a direction inclined with respect to the longitudinal direction of the rack.

17. A serial printer as set forth in claim 15, wherein said dislodging member is mounted to the carriage.

18. A serial printer as set forth in claim 15, wherein said edge of the dislodging member is substantially parallel with an imaginary plane connecting the peaks of the teeth of the rack.

* * * * *